US010378199B2

(12) United States Patent
Calderon Uriszar-Aldaca et al.

(10) Patent No.: US 10,378,199 B2
(45) Date of Patent: Aug. 13, 2019

(54) DRY JOINT JOINING DEVICE BETWEEN COLUMNS AND BEAMS OF PRECAST REINFORCED CONCRETE

(71) Applicant: FUNDACION TECNALIA RESEARCH & INNOVATION, San Sebastian-Guipuzcoa (ES)

(72) Inventors: Inigo Calderon Uriszar-Aldaca, San Sebastian-Guipuzcoa (ES); Amaia Aramburu Ibarlucea, San Sebastian-Guipuzcoa (ES); Jose Antonio Chica Paez, San Sebastian-Guipuzcoa (ES)

(73) Assignee: FUNDACION TECNALIA RESEARCH AND INNOVATION, Guipuzcoa (ES)

( * ) Notice: Subject to any disclaimer, the term of this patent is extended or adjusted under 35 U.S.C. 154(b) by 98 days.

(21) Appl. No.: 15/324,370

(22) PCT Filed: Jun. 25, 2015

(86) PCT No.: PCT/ES2015/070498
§ 371 (c)(1),
(2) Date: Jan. 6, 2017

(87) PCT Pub. No.: WO2016/005632
PCT Pub. Date: Jan. 14, 2016

(65) Prior Publication Data

US 2017/0175376 A1 Jun. 22, 2017

(30) Foreign Application Priority Data

Jul. 7, 2014 (EP) ..... 14382262

(51) Int. Cl.
*E04B 1/19* (2006.01)
*E04B 1/21* (2006.01)
(Continued)

(52) U.S. Cl.
CPC ..... *E04B 1/215* (2013.01); *E04B 1/1912* (2013.01); *E04B 1/40* (2013.01); *E04C 5/16* (2013.01); *E04C 5/162* (2013.01); *E04B 2103/02* (2013.01)

(58) Field of Classification Search
CPC ..... E04B 1/1912; E04B 1/215; E04B 1/4157; E04B 1/41; E04B 1/40; E04B 2001/1915; E04C 5/165; E04C 5/162; E04C 5/16
See application file for complete search history.

(56) References Cited

U.S. PATENT DOCUMENTS 4,666,326 A * 5/1987 Hope ..... E04C 5/165 403/13
5,410,847 A * 5/1995 Okawa ..... E04B 1/30 403/346

(Continued)

FOREIGN PATENT DOCUMENTS

EP 1925757 A1 * 5/2008 ..... E04B 1/215
JP 2007270455 A * 10/2007
WO WO-0125558 A1 * 4/2001 ..... E04B 1/1912

OTHER PUBLICATIONS

International Search Report and Written Opinion for International Application No. PCT/ES2015/070498 dated Mar. 3, 2016 (11 pages).

*Primary Examiner* — Christine T Cajilig
(74) *Attorney, Agent, or Firm* — Andrus Intellectual Property Law, LLP

(57) ABSTRACT

A joining device (100) for precast reinforced concrete elements with a dry joint comprising a first group of joining reinforcements (10') arranged on a first plane and in parallel with one another, each one of said joining reinforcements (10) comprising one reinforcement (1) and two threaded ends (2). The device comprises first coupling means (30) for coupling to the columns (200) arranged between the joining
(Continued)

reinforcements (10) and perpendicular to the first plane defined by the joining reinforcements (10) and a plurality of anchoring plates (20) arranged so as to define a closed frame inside of which the joining reinforcements (10) are arranged, and where the inner space defined by the anchoring plates (20) is filled with a structural filler material (concrete, resin, composite, etc.) (50). The anchoring plates (20) comprise a plurality of holes (21), at least one for each threaded end (2), in a position that matches up with the latter, and through which the threaded ends (2) remain accessible. The device comprises second coupling means (40) between the threaded ends (2) and the beam (300) rebars.

14 Claims, 5 Drawing Sheets

(51) Int. Cl.
*E04B 1/41* (2006.01)
*E04C 5/16* (2006.01)

(56) References Cited

U.S. PATENT DOCUMENTS 5,675,943 A * 10/1997 Southworth ..... E01D 19/00 52/167.1
6,345,473 B1 * 2/2002 Fink ..... E04B 1/215 52/127.7
2012/0085050 A1 * 4/2012 Greenwood ..... E04B 1/41 52/296
2016/0312459 A1 * 10/2016 Hochstuhl ..... E04B 1/41

* cited by examiner

DRY JOINT JOINING DEVICE BETWEEN COLUMNS AND BEAMS OF PRECAST REINFORCED CONCRETE

CROSS-REFERENCE TO RELATED APPLICATIONS

This patent application is a national stage filing under 35 U.S.C. § 371 of International Application No. PCT/ES2015/070498, filed Jun. 25, 2015, which claims the benefit of priority of Spanish Patent Application No. 14382262.5, filed Jul. 7, 2014, which are incorporated herein by reference in their entireties.

The object of the present invention is a junction between columns and beams of precast reinforced concrete, with a dry joint, i.e. by means of a joint that on site does not require formwork, pouring fresh concrete, and a period for the concrete to set in order to acquire its required strength, and which makes it possible to build high-rise buildings with a competitive edge, even in seismic risk areas. To this end, the present invention proposes a system that is open and universal, and may be adapted to the different possible geometries and cases, and which has a joint that is dry and makes it easy to join together the different parts, ensuring stability, even with loads that are dynamic. The present document therefore describes a universal solution carried out with steel and a structural filler material (concrete, resin, composite, etc.) that is adaptable, easy to implement and durable.

STATE OF THE ART

The technical problem that the present invention solves is joining together precast concrete beams and columns, which is related to building high-rise buildings, with an economically competitive edge. To build with a competitive edge, an open and universal system is needed which may be adapted to the different possible geometries and cases in order to join together the different parts without having to wait for the concrete to set, and without the need for specialized work guilds on site such as welders or formworkers, which end up making construction more expensive. To build high-rises, and especially in seismic risk areas, it is necessary to take into account not only weight and overloading, but also horizontal actions, wind and seisms, in such a way that the joining means ensure stability even when faced with loads that are dynamic.

In the current state of the art, various solutions have been put forth for column-column connections, and for column-beam connections. Among them, one might point out the Korean document KR101260392, which defines junctions for precast columns and beams constituted by three basic elements: junctions between columns, called CLM, joining nodes, called HM, and beam junctions, called BLM.

The portion of said invention that handles the junction between beams and columns is the one formed by the assembly of the junctions between beams, BLM, and the one corresponding to the joining node, HM.

The joining node, HM, is in turn formed by up to four structural steel cantilevers formed by T beams, situated every 90 degrees, which act as the springing point of the beams and are joined together in different ways, being either welded together or connected by means of bolts to a concrete core. The vertical load of the column is transmitted from the top portion of the node to the bottom portion either by means of a connection carried out with structural steel, which makes if hard for the rebar to pass from one side to another, both for beams and for columns, or else by leaving the open space, and passing the rebar and concreting in situ.

Moreover, the junction between the cantilever and the beam, BLM, is made by connecting, at the point having zero bending moment, an equal number of structural steel cantilevers with joint covers, connecting the rebars together and concreting the assembly in situ, forming the beam and the meeting point between column and beam. It is thus ultimately not a precast means of connection between beam and column, but rather between pre-beam and column.

Therefore, the differences between this system and the one being proposed herein are as listed below:

In the first place, it is not strictly speaking a system for joining between precast concrete beams and columns, but rather between pre-beams and concrete columns.

In the second place, it does not solve the problem by means of a single system, but rather two systems that are clearly separate and identified as BLM and HM.

In the third place, it is not an open system, but rather requires specific precast elements, and therefore does not allow for operations to adapt it to the most commonly found types, since it requires embedded structural steel elements with set characteristics. On and beyond straight, prismatic elements, with set types of rebar.

In the fourth place, it is not a dry-joint system, as the junction always requires in situ concreting in order to be durable, which has a negative effect on the construction times of high-rise buildings, since it necessitates waiting through setting times and so forth.

In the fifth place, it is not an seismseism-resistant junction. The reinforcements in some solutions are continuous, but lack cores capable of transmitting stress, with just a small I beam transmitting compressive and shear stress, which however is centered on the column, making it totally ineffective to resist bending moments. The springing points of the columns are at points with zero shearing forces in one direction, but said points will not match up in both directions except in buildings with double symmetry that are totally regular in terms of both their plan and elevation view, which is a too much specific case. The solution of said column springing points does not connect the reinforcements together, but passes them through the connection piece; since they are always located in places without zero bending moment, this has a negative effect on structural behavior. Lastly, there is likewise not any specific solution to transmit the axial forces of the beams by shear forces in the columns.

Document JP5160907 describes in detail certain connections between the continuous beam elements with other beams, by means of male-female joints, fasteners and joint covers. However, the means of connection to the precast columns is similar. In order to avoid making the joint between elements too close to the area with maximum shear stress, and to keep the reinforcements from working in this way, a column segment and beam cantilevers may be joined in a continuous part. The column segment has rebars which act as a male end on one side, and has holes in the other end into which the reinforcements of the next segment fit. The connection is carried out by means of fitting and resins. The cantilevers presented in this system cover half the span of the beams, connecting at the mid-point, which minimizes shear stresses and maximizes axial stresses. It is a closed system, as it is not intended for connecting conventional beam and column systems, but rather elements that are already formed by half column sections and half beams. Lastly, the shear and bending diagrams in beams for permanent loads are presented, without taking into account other actions such as seisms, which involve other factors.

Patent JP5154962 offers a solution based on the same principle, which is not so much a means of joining together precast beams and columns, but rather a closed precast beam-column that connects with itself.

The foregoing systems are wet, as they require in situ concreting or the use of resins, and are closed, meaning they are only valid for use with elements that have already been designed to act with them. They are not adaptable systems, since variations in geometry, such as column sections with various heights or beams with various spans, would make these solutions impracticable, as it would be impossible to combine them. Neither are they a single joining means for precast beam and column elements, but rather the same solution divided into two parts or a distinct precast element, with its corresponding joining means. Lastly, they do not consider the effect of horizontal actions such as seisms and, in some cases, the possible shearing effects on the reinforcements as a result of situating the joint sections at points that could be subject to significant shear stress. They only present the factors of permanent actions, such as dead weight and dead loads, which goes to show the lack of consideration for other crucial actions such as wind or seisms.

Therefore, these systems require a high implementation investment, requiring formwork molds and specific proper elements for everything. These systems are not compatible with other precast systems, and it is not possible to apply them to a wide range of building geometries, nor do they ensure structural safety in seismic areas, thus limiting their applicability.

DESCRIPTION OF THE INVENTION

For the purpose of solving the technical problems described above, the present invention describes, in a first aspect, a dry joint joining device between columns and beams of precast reinforced concrete, comprising:

a first group of joining reinforcements arranged on a first plane and in parallel with each other (the joining reinforcements are oriented on a first plane in such a way that with the device assembled for use thereof the reinforcements are aligned with the reinforcements of the beams to be joined together), each one of said joining reinforcements comprising one reinforcement and two threaded ends (the joining reinforcements may constitute reinforcements having threaded studs welded onto the ends thereof, or may be reinforcements with threaded ends), first coupling means for coupling to the columns arranged between the joining reinforcements and perpendicular to the first plane defined by the joining reinforcements (these coupling means are provided in order to be coupled or to enable the rebars of the columns to pass through), a plurality of anchoring plates arranged so as to define a closed frame inside of which the joining reinforcements are arranged, and where the inner space defined by the anchoring plates is filled with a structural filler material (concrete, resin, composite, etc., carried out in the shop, not on site), in such a way that the joining reinforcements and the first coupling means are partially embedded within said structural filler material (specifically, the reinforcements are completely embedded but the threaded ends are not). The anchoring plates contain a plurality of holes, at least one for each threaded end, in a position that matches up with said threaded ends, in such a way that through said holes the threaded ends of the joining reinforcements remain accessible, second coupling means for coupling between the threaded ends and the beam rebars (these second coupling means remain outside the frame defined by the anchoring plates, allowing the portion of the threaded ends that protrudes through the holes in the plates to be connected to the ends of the beam rebars).

The joining device may comprise a second group of joining reinforcements arranged on a second plane and in parallel with one another, the second plane being parallel to the first plane. This second group of reinforcements also becomes partially embedded in the filler material (for example concrete, resin or composite). These reinforcements may be oriented in parallel to the reinforcements of the first group, for example to join beams with several rows of rebars, or may be arranged in a direction that is perpendicular to the first group of reinforcements, when joining beams arranged at right angles, for example beams forming a corner of a building, or which cross one another at an intermediate column.

The device may of course incorporate three or more groups of reinforcements forming several parallel planes of joining reinforcements, it being possible for the reinforcements of each plane to be oriented in the same direction or in perpendicular directions to one another.

In a particular embodiment, the joining reinforcements are bifurcated, comprising two reinforcements and two threaded ends, the reinforcements being parallel to one another in such a way that they create a space for the first coupling means to pass through. The bifurcated reinforcements will be used depending on the position of the beam rebars to be joined together, and on the position of the column rebars, in such a way that in cases in which the column rebars intersect with the beam rebars, the joining reinforcements will be bifurcated in order to leave a space for the column rebars to pass through, whereas when it is not necessary, non-bifurcated joining reinforcements will be used.

The bifurcated reinforcement is constituted by welding a first threaded stud or reinforcement segment onto one of the ends of the two reinforcements, leaving an overlap of at least two-and-a-half diameters of reinforcement, in such a way that the reinforcements are then situated so as to the diametrically opposite one another with respect to the stud or segment, then carrying out the same operation with a second stud or segment on the other end of the reinforcements.

In a further specific embodiment, the first coupling means for coupling to the columns are tubes designed to house the ends of the column rebars (the first coupling means may be just means for the column rebars to pass through the joining device of the invention, in such a way that the end of the column rebars remains accessible for joining to the reinforcement of a contiguous column).

In a further embodiment, the second coupling means are nuts configured to join the threaded ends of the reinforcements to threaded ends of the rebars of at least one beam. These screws remain outside the frame defined by the anchoring plates, allowing the portion of the threaded ends that protrudes through the holes in the plates to be connected to the ends of the beam rebars.

Another object of the invention is a method for manufacturing a dry joint joining device between columns and beams of precast reinforced concrete, characterized in that it comprises the steps of:

a) obtaining a joining reinforcement that comprises one reinforcement and two threaded ends (the joining reinforcements may constitute reinforcements having threaded studs welded onto the ends thereof, or may be reinforcements with threaded ends), b) aligning a first group of joining reinforcements on a first plane and in parallel with one another (the joining reinforcements are oriented on a first plane in such a way that with the device assembled for use thereof the reinforcements are aligned with the rebars of the beams to be joined together), c) incorporating first coupling means for coupling to the columns between the joining reinforcements and perpendicular to the first plane (in such a way that they enable the coupling or passage of the reinforcements of a column), d) placing a plurality of anchoring plates arranged so as to define a closed frame inside of which the first group of joining reinforcements is arranged, e) inserting each threaded end of the joining reinforcements through holes in each anchoring plate, f) filling the inner space defined by the anchoring plates with a structural filler material (concrete, resin, composite, etc.) in such a way that the reinforcements will be completely embedded but the threaded ends will not, g) placing second coupling means for coupling between the threaded ends and the beam rebars to close the holes through which the studs protrude (in such a way that the second coupling means remain outside the frame defined by the anchoring plates, allowing the portion of the threaded ends that protrudes through the holes in the plates to be connected to the ends of the beam rebars).

In a particular embodiment of the method, the anchoring plates are welded into position by means of a fillet weld bead, welded on the inside of the corner, leaving a space of 10 mm from the edge on both sides, and with a throat of at least 5 mm.

In a further particular embodiment, the method comprises superimposing a second group of joining reinforcements on a second plane in parallel to the first plane. This second group of reinforcements is arranged in a direction that is perpendicular to the first group of reinforcements. This second group of reinforcements also becomes partially embedded in the structural filler material. These reinforcements may be oriented in parallel to the reinforcements of the first group, for example to join beams with several levels of reinforcements, or may be arranged in a direction that is perpendicular to the first group of reinforcements, when joining beams arranged at right angles, for example beams forming a corner of a building, or which cross one another at an intermediate column.

The device may of course incorporate three or more groups of reinforcements forming several parallel planes of joining reinforcements, it being possible for the reinforcements of each plane to be oriented in the same direction or in perpendicular directions to one another.

In a further embodiment, the joining reinforcements have a bifurcated shape, comprising two reinforcements and two threaded ends, the reinforcements being parallel to one another in such a way that they create a space for the first coupling means to pass through.

In a further particular embodiment, the first coupling means are tubes, while in a further particular embodiment, the second coupling means are nuts.

Lastly, another object of the invention is the use of the joining device described above with a precast column that comprises, at least, one cantilever for supporting at least one beam and a plurality of ends of the vertical rebars of the column in such a way that said joining device is placed upon the ends of the vertical rebars of the column, joining together said ends by means of first coupling means of said joining device, allowing the device to rest upon the springing point of the column, in such a way that at least one precast beam is situated upon at least one cantilever, allowing its weight to rest thereon, and is brought closer, bringing threaded ends of the beam reinforcement face-to-face with second coupling means of the joining device, joining them together.

By means of the invention described, a junction is obtained which is made of steel and a structural filler material (concrete, resin, composite, etc.) and which may be used universally, i.e. it is an open solution that may be adapted to different sections, geometries and frameworks, being compatible with a wide variety of cases. When compared with the current solutions described in the State of the Art, is it simple to manufacture and has a dry joint, i.e. the junction is completed in the moment by tightening screws, without time spent waiting for concrete to set. Lastly, it is worth pointing out that it is meant to transmit stress between precast concrete elements as if it were a continuous section of concrete, wherein the junction is more durable than the actual precast elements to be joined, taking into account the transmission of bending moment and shear stress which, where applicable, would be expected in seismic risk areas, as well as the connection of reinforcements, seeking negative work and the membrane effect in the event of failure.

Throughout the description and the claims, the word "comprises" and variants thereof are not intended to exclude other technical characteristics, additions, components or steps. For those skilled in the art, other objects, advantages and characteristics of the invention may be deduced from both the description and the practical use of the invention. The following examples and drawings are provided by way of illustration, and are not meant to restrict the present invention. Furthermore, the present invention covers all of the possible combinations of particular and preferred embodiments indicated herein.

BRIEF DESCRIPTION OF THE DRAWINGS

What follows is a very brief description of a series of drawings which help to a better understanding of the invention, and which are expressly related to an embodiment of said invention that is presented by way of a non-limiting example of the same.

DESCRIPTION OF A DETAILED EMBODIMENT OF THE INVENTION

Figure 1:
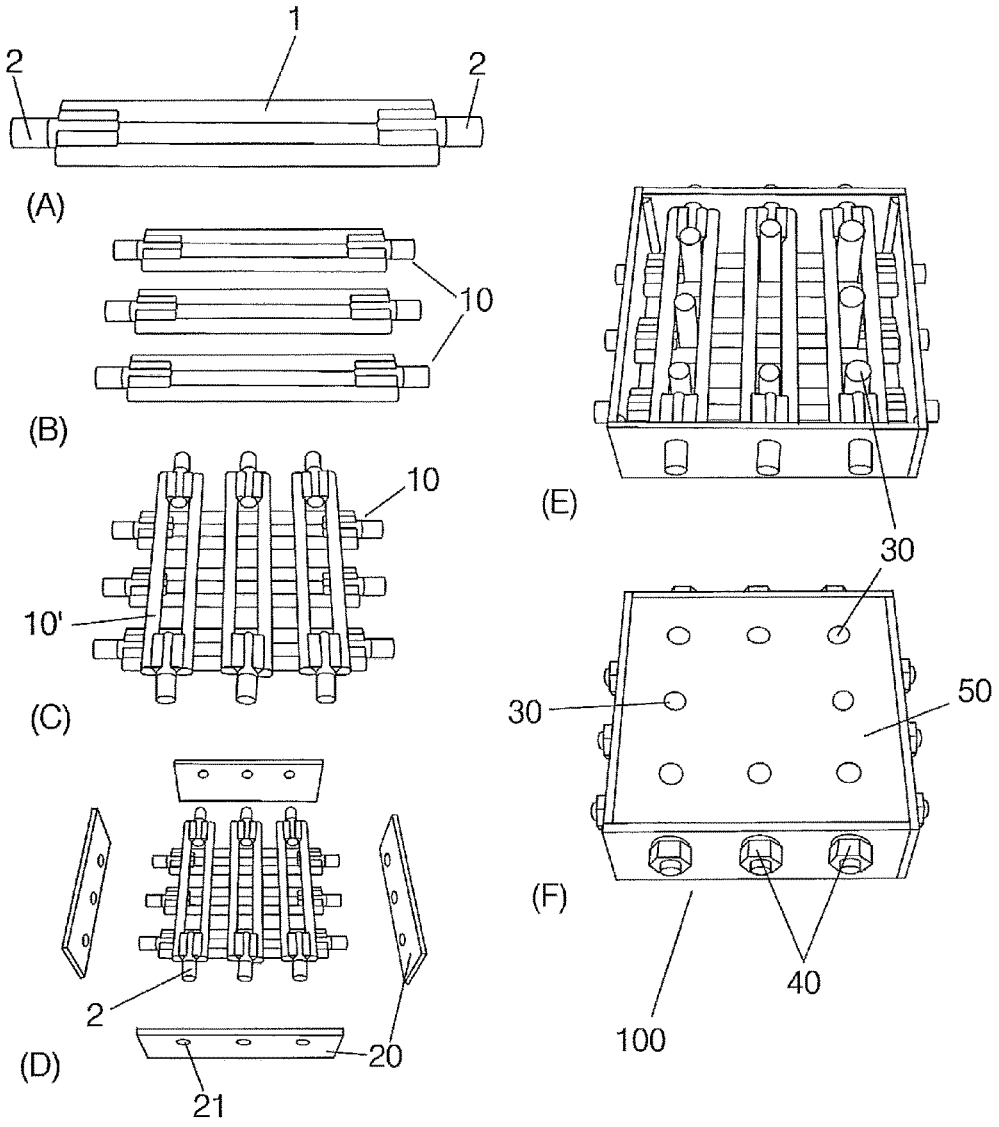
FIG. 1—Shows the manufacturing sequence of the joining device object of the invention.

As shown in FIG. 1, the joining device of the present invention is manufactured according to the following sequence. First of all (A), threaded studs (2) are welded onto reinforcements (1), at least one threaded stud (2) for each side of each reinforcement (1), forming a joining reinforcement (10,10'). In a second stage (B), the first group of reinforcements (10) is aligned on a single plane and in parallel with one another. In a third stage (C) a second group of reinforcements oriented in perpendicular (10') is superimposed upon the first group of reinforcements (10). In this way, in each case, as many planes may be superimposed as there are beam directions, and as many rows of reinforcements as there are for each direction. In a fourth stage (D), and once the joining reinforcements (10,10') have been placed in perpendicular, a plurality of anchoring plates (20) are placed, inserting each threaded stud (2) of the joining reinforcements (10,10') through the holes (21) of each anchoring plate (20), forming an enclosure and welding the anchoring plates (20) into this position by means of a fillet weld bead, welded on the inside of the corner, leaving a space of 10 mm from the edge on both sides, and with a throat of at least 5 mm. In a fifth stage (E) a plurality of plastic or rubber tubes (30) are inserted between the spaces of the joining reinforcements (10,10') for vertical rebars of a column to pass through. Lastly, in a sixth stage (F), a plurality of nuts (40) are placed in order to close the holes (21) through which the studs (2) protrude, and a structural filler material (concrete, resin, composite, etc.) (50) is used to fill the inner space delimited by the anchoring plates (20), which make the actual formwork enclosure.

Therefore, the joining device (100) thus produced comprises a plurality of joining reinforcements (10,10') arranged on two planes that are perpendicular to one another, wherein each one of said joining reinforcements (10,10') comprises, in turn, one reinforcement (1) and one threaded stud (2) welded onto each one of the ends of the reinforcement (1); and wherein said joining reinforcements (10,10') are enclosed by a plurality of anchoring plates (20) arranged around the perimeter of the assembly and with at least one plate (20) for per side comprising a plurality of holes (21) numbering at least one per stud (2) and in a position matching up with the latter, the assembly being completed with a plurality of nuts (40) numbering at least one per stud (2). Furthermore, the joining device comprises a plurality of tubes (30) arranged vertically between the joining reinforcements (10,10'), the assembly being made rigid by means of concreting (50) the inner space defined by the anchoring plate (20) enclosure.

In this embodiment, the tubes (30) form first coupling means for coupling with the columns (200), while in this particular embodiment the nuts (40) are second coupling means for coupling with the beams (300). Nevertheless, other coupling means that are not the aforementioned tubes and nuts may be suitable as long as they have the right form to carry out their coupling function.

Figure 6:
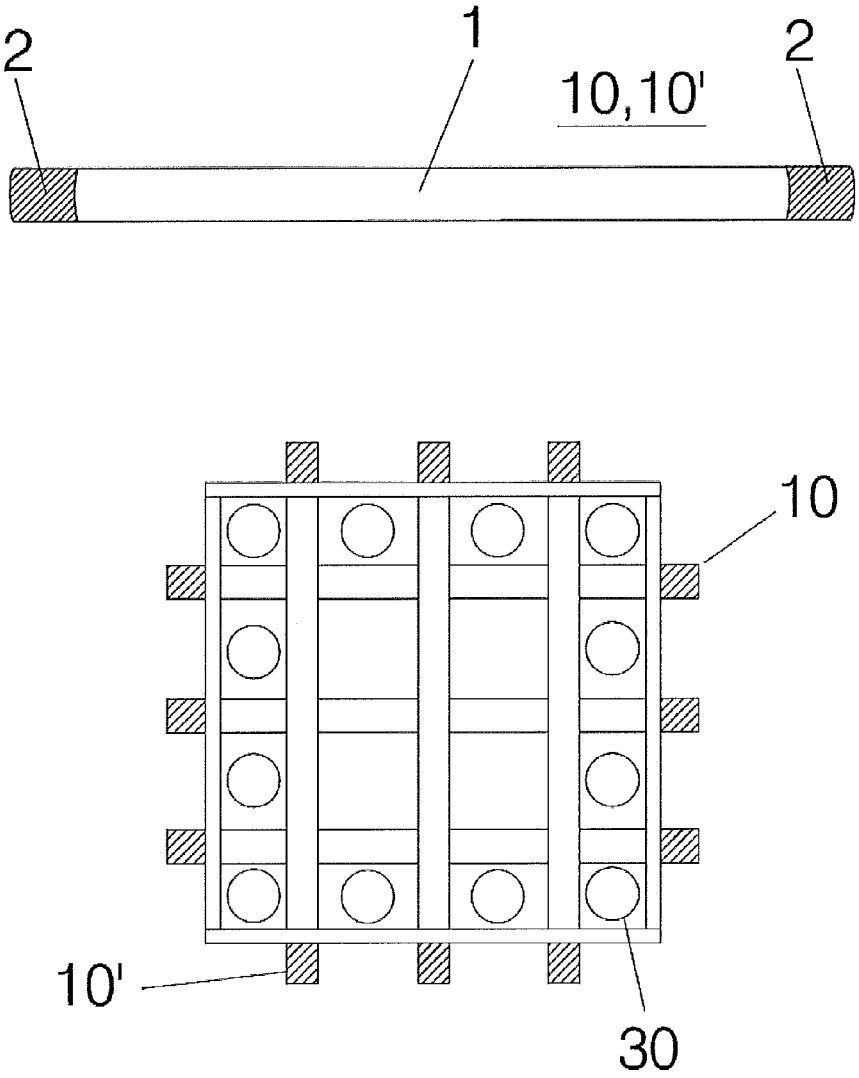
FIG. 6—Shows a plan view of phase E of the joining device object of the present invention, with simple reinforcements, including a detail of said simple reinforcement.
Figure 7:
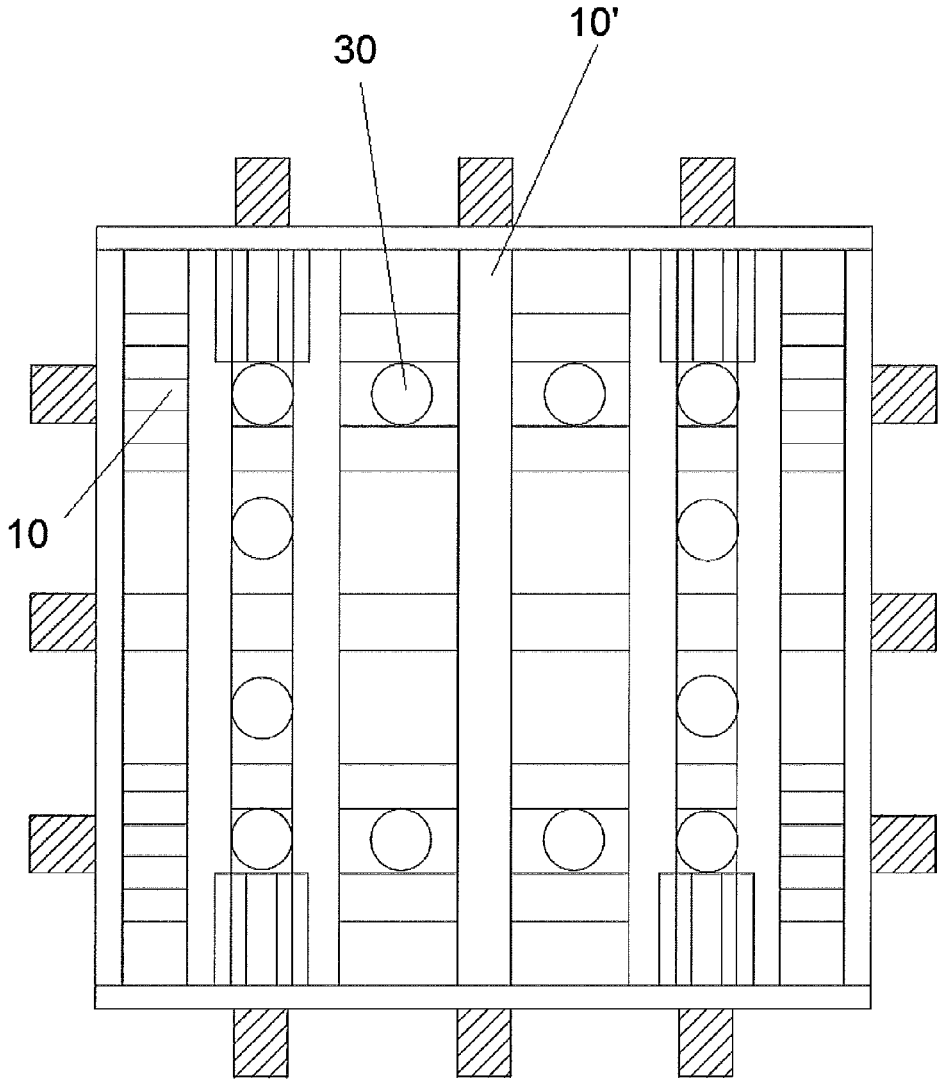
FIG. 7—Shows a plan view of phase E of the joining device object of the present invention, combining bifurcated reinforcements and simple reinforcements.

Moreover, the joining reinforcements (10,10') may be bifurcated reinforcements, depending on the design conditions (as in the example shown in FIG. 1), or simple ones, as in the example shown in FIG. 6, or else combining both types of reinforcements, as in FIG. 7.

Figure 2:
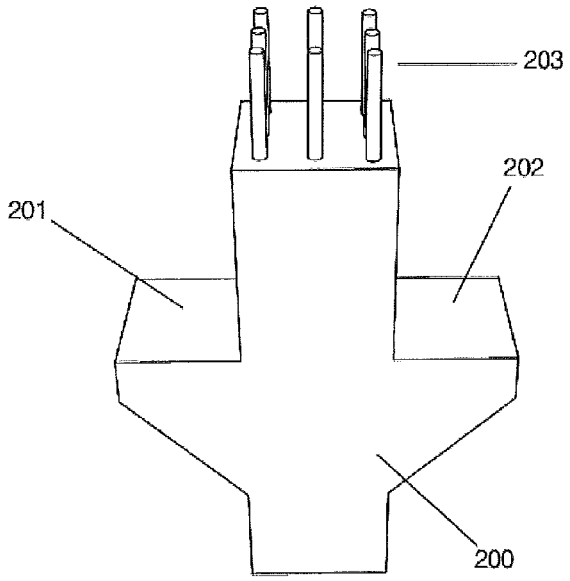
FIG. 2—Shows a perspective view of a column for receiving precast concrete beams.

Thus, the joining device shown in FIG. 2 is manufactured in a very easy way, as shown in FIG. 1, with common and inexpensive components that are repeated several times through symmetry. The geometry of the junction is defined by means of the following external variables used as boundary conditions in its design.

General External Variables r Cover of the reinforcement, with r≥10 mm

External Variables Related to the Column $L_x$ Side length in direction x, with $L_x \geq 200$ mm.

$L_y$ Side length in direction y, with $L_y \geq 200$ mm.

$\phi_x$ Diameter of the bending rebar for bending moment Mx, with $\varnothing_x$ □ [10,40] mm.

$n_{p,x}$ Number of round rebars in direction x, with $n_{p,x}$ □ [3,5].

$\phi_y$ Diameter of the bending rebar for bending moment My, with $\varnothing_y$ □ [10,40] mm.

$n_{p,y}$ Number of round rebars in direction y, with $n_y$ □ [3,5].

Type Type of column in floor plan: corner, edge, inside

External Variables Related to the Beams $B_x$ Width of the beam in the direction aligned with x, with $B_x$ □.

$\phi_{v,x}$ Diameter of the rebar of the beam aligned with x.

$n_{v,x}$ Number of round rebars of the beam aligned with x.

$f_{v,x}$ Number of rows of reround bars of the beam aligned with x.

$sf_{v,x}$ Separation between rows of round rebars of the beam aligned with x.

$B_y$ Width of the beam in the direction aligned with y.

$\phi_{v,y}$ Diameter of the rebars in the beam aligned with direction y.

$n_{v,y}$ Number of round rebars of the beam aligned with y.

$f_{v,y}$ Number of rows of round rebars of the beam aligned with y.

$sf_{v,y}$ Separation between rows of round rebars of the beam aligned with y.

Based on the general variables associated with the columns and the beams, there are three basic components that are joined together to form the junction: the reinforcements (1), the plates (20), and, if applicable, the studs (2). The reinforcements (1) and the studs (2) are joined together in one component, the joining reinforcements (10,10'), which may or may not be bifurcated; in the latter case the studs would not be absolutely necessary as it would be enough for the reinforcement to have both of its ends worked so as to form a thread.

Design Conditions of the Continuous Joining Reinforcements (10,10'), According to FIG. 6

The continuous joining reinforcements are made up of either a section of reinforcement whose ends have been worked into a thread, or of a section of reinforcement with studs welded onto each of its ends, aligned in the same direction, with the threads facing outwards. The geometric constraints are the diameter and steel of the reinforcement of the incident beam, $\phi_v$, the side of the column in this direction, L, and the thickness of the anchoring plates, t.

The continuous joining reinforcement is to have at least the same strength as the reinforcement of the incident beam. In order to ensure this, it is sufficient for the steel and diameter, $\phi$, of the continuous joining reinforcement to be the same as those of the incident beam, $\phi_v$, where the diameter may be larger, or even smaller if the steel is stronger.

The welded-on studs are to be stronger than the section of reinforcement, ensuring that breakage never takes place in the stud itself. For this purpose its metrics, Met, and the minimum nominal values of the steel, expressed based on their yield strength, $f_{yb}$, and ultimate strength, $f_{ub}$, are to be chosen so as to fulfill said minimum condition.

The welding of the studs to the ends of the section of reinforcement is to be carried out in such a way as to ensure the total transmission of stress between the stud and the section of reinforcement, ensuring that the section of reinforcement will fail before the weld. In a particular embodiment, this is ensured by joining them together by means of butt welding.

The total length of the joining reinforcement, formed by the section of reinforcement with two threaded ends or the section of reinforcement with two welded-on studs, is to be enough to exceed the side of the column in the corresponding direction, L, twice the thickness of the plates, t, and twice the length needed to screw on a nut that transmits all the stress.

In the particular case of reinforcements with a nominal yield strength, $f_{sk}$, of 500 MPa or less, the minimum characteristics of the studs, reinforcements, and weld beads is to be as shown in the following table:

| $\Phi_v$ [mm] | Met [mm] | $f_{yb}$ [MPa] | $f_{ub}$ [MPa] | $\Phi$ [mm] |
|---|---|---|---|---|
| 12 | 12 | 640 | 800 | 12 |
| 16 | 16 | 640 | 800 | 16 |
| 20 | 20 | 640 | 800 | 20 |
| 25 | 24 | 900 | 1000 | 25 |
| 32 | 33 | 640 | 800 | 32 |

Design Conditions of the Bifurcated Joining Reinforcements (10,10'), According to FIG. 1

In cases where, due to the number of round reinforcement bars of the column in any of its directions, the reinforcements intersect in space with the reinforcements of the beams, it is proposed that the reinforcements be bifurcated, leaving enough space for the vertical reinforcements to pass through.

Thus, there are two geometric constraints for the bifurcation of the reinforcements. On the one hand, the diameter of the equivalent horizontal reinforcement, $\phi_{eq}$, which will condition the minimum size of the bolt, and therefore its metrics, Met, and the minimum quality of the steel, as well as the diameter of the two bifurcation reinforcements, $\phi_{bif}$ and the minimum geometry of the weld bead with its length, $L_{cor}$, throat a and width w, depending on its strength. On the other hand, the diameter of the vertical reinforcement, either $\phi_x$ or $\phi_y$, which can cause the metrics of the stud to vary so as to adapt to the diameter of the passing reinforcement.

The value of S is the separation between the reinforcements and the stud when they are welded to form the bifurcation. 1-2 mm is the norm; they are not welded while pressed together.

The following table 1 shows, for the particular case of reinforcements whose nominal yield strength tension, $f_{sk}$, is 500 MPa or less, several minimum conditions depending on the diameter of the equivalent horizontal reinforcement. The values of the variables expressed in the table are the minimum values, it being possible to use larger ones if so desired.

The following table 1 shows the minimum geometry of the stud, Met, the characteristics of the steel of the stud, expressed in minimal nominal values of the yield strength, $f_{yb}$, and ultimate strength, $f_{ub}$, minimum diameter of the bifurcated reinforcements, $\phi_{bif}$, and definition of the minimum manual arc weld beads of the stud and the bifurcated reinforcement, with its length, $L_{cor}$, throat a, width w and separation s.

| $\Phi_{eq}$ [mm] | Met [mm] | $f_{yb}$ [MPa] | $f_{ub}$ [MPa] | $\Phi_{bif}$ [mm] | $L_{cor}$ [mm] | w [mm] | A [mm] | s [mm] |
|---|---|---|---|---|---|---|---|---|
| 12 | 12 | 640 | 800 | 10 | 25 | 7.5 | 3 | 1-2 |
| 16 | 16 | 640 | 800 | 12 | 30 | 10 | 4 | 1-2 |
| 20 | 20 | 640 | 800 | 16 | 40 | 12.5 | 5 | 1-2 |
| 25 | 24 | 900 | 1000 | 20 | 50 | 15 | 6 | 1-2 |
| 32 | 33 | 640 | 800 | 25 | 62.5 | 20 | 7.5 | 1-2 |

Bearing in mind that the entrance $\phi_{eq}$ of the table 1 will be, for a given case, $\phi_{eq,x}$ in direction x, in accordance with equation (1), and $\phi_{eq,y}$ in direction y, according to equation (2), both of which are shown below:

$$\Phi_{eq,x}=\Phi_{v,x} \tag{1}$$

$$\Phi_{eq,y}=\Phi_{v,y} \tag{2}$$

Likewise, as mentioned previously, it is necessary to ensure that the vertical reinforcements can pass through, such that, once more, for a given case:

$$\{\Phi_x,\Phi_y\}\leq \text{Met}+2\cdot s+2\cdot e_t \tag{3}$$

Basically, this inequation implies that the empty space between reinforcements of the bifurcation, which is the sum of the metrics of the stud, twice the separation between stud and reinforcement, and twice the thickness of the tube, should be greater than the diameter of the corresponding vertical reinforcement.

Thus, the metrics of the stud in direction x, $\text{Met}_x$, will also be conditioned by inequation (4), and in direction y, $\text{Met}_y$ will be conditioned by inequation (5), suitable metrics being the smallest ones to simultaneously fulfill the conditions of the table which are structural conditions, and of inequations (4) and (5), which are geometric-type conditions:

$$\text{Met}_x\geq \Phi_x-2\cdot s-2\cdot e_t \tag{4}$$

$$\text{Met}_y\geq \Phi_y-2\cdot s-2\cdot e_t \tag{5}$$

The length of the shank of the stud $L_c$, i.e. the non-threaded portion of the total length, is to be at least equal to the sum of the thickness of the anchoring plate t and the length of the weld bead $L_{cor}$, as expressed in the following inequation (6):

$$L_c\geq L_{cor}+t \tag{6}$$

The length of the threaded portion $L_{ros}$ is to be greater than or equal to twice the height of the standard nut corresponding to high-strength screws with the metrics of the stud, such that it will be greater than or equal to the length expressed in Table 2.

Table 2 shows Minimum threaded lengths, $L_{ros}$, based on the metrics of the stud.

| Met [mm] | $L_{ros}$ [mm] |
|---|---|
| 10 | 16 |
| 12 | 20 |
| 16 | 26 |
| 20 | 32 |
| 22 | 36 |
| 24 | 38 |
| 27 | 44 |
| 30 | 48 |
| 33 | 52 |
| 36 | 58 |

The length of the bifurcated reinforcements $L_{bif}$ in each of the directions x and y, will depend on the side of the corresponding column, $L_x$ or $L_y$, in a given case, of the cover, r, of the concrete, of the lengths of the weld bead $L_c$ obtained according to the table 1 in the corresponding direction, as well as the thickness of the chosen tube $e_t$.

$$L_{bif,x}=L_x-2\cdot r+2\cdot L_{cor}+2\cdot e_t \quad (7)$$

$$L_{bif,y}=L_y-2\cdot r+2\cdot L_{cor}+2\cdot e_t \quad (8)$$

Design Conditions of the Anchoring Plates (20).

In all cases, the anchoring plates are to be made of steel with a nominal yield strength of at least 275 MPa or higher. The anchoring plates in direction x are to have a thickness $t_x$, a length $L_{ca,x}$ and a border $h_x$. They are to have $n_{v,x}$ circular holes with a diameter $d_{0,x}$ passing through the entire thickness, situated in one single row. The distances between rows of one single side are to be equal to the separations of the incident reinforcements, $sf_{v,x}$ and $sf_{v,y}$, according to the given side, and will have as many rows as there are rows of reinforcements, $f_{v,x}$ and $f_{v,y}$, according to the given side, with distances from the end rows to the edges of the border $e_{l,x}$ and $e_{r,x}$ and distances from the end holes of each row to the edges of the long side $e_{t,x}$ and $e_{b,X}$, keeping the equal distance between the holes of each single row equal to $p_x$. The minimum dimensions thus defined will maintain their relationships to one another and with the rest of elements of the junction expressed in the following equations (9) and (15).

$$t_x \geq 0,4\cdot\Phi_{v,y} \quad (9)$$

$$h_x \geq e_{t,x}+e_{i,y}+\frac{\Phi_{bif,x}}{2}+\frac{\Phi_{bif,y}}{2} \quad (10)$$

$$L_{ca,x}=L_{bif,x}+t_y \quad (11)$$

$$d_{0,x}=\Phi_{v,y}+2\cdot\text{mm} \quad (12)$$

$$p_x=\frac{L_{ca,x}-e_{i,x}-e_{d,x}}{n_{v,y}-1} \quad (13)$$

$$e_{d,x}=e_{i,x}+t_y \quad (14)$$

$$e_{b,x}=h_x-e_{i,x} \quad (15)$$

In turn, the minimum values of $e_{i,x}$ (distance from the left edge) and $e_{t,x}$ (distance to the top edge) may be obtained from Table 3 below:

| Met [mm] | $e_{i,x}$ [mm] | $e_{t,x}$ [mm] |
|---|---|---|
| 10 | 15 | 15 |
| 12 | 20 | 20 |
| 16 | 25 | 25 |
| 20 | 30 | 30 |
| 22 | 30 | 30 |
| 24 | 35 | 35 |
| 27 | 40 | 40 |
| 30 | 40 | 40 |
| 33 | 45 | 45 |
| 36 | 50 | 50 |

In direction y the same equations (9) to (15) would be applied, along with table 3 above, but substituting x with y and vice versa.

As an example, a joining device (100) is presented which is made based on the specifications made herein above for the case of a 30×30 cm column, with all of the reinforcements having ϕ=25 mm and 3 round bars in each direction.

In order to place the joining device (100) object of the invention, a section of precast column (200) such as the one presented in FIG. 2 is initially available. It is a classic column design, with two cantilevers (201,202) to support the beams (300) and the ends of the reinforcements (203) of the vertical reinforcement of the column.

Figure 3:
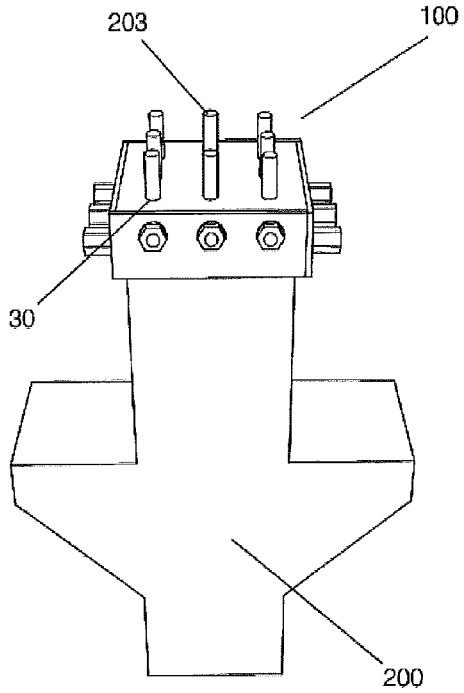
FIG. 3—Shows a perspective view of the column of FIG. 1 with a joining device in accordance with the present invention.

In the first place, the joining device (100) is placed upon the ends (203) of the vertical rebars of the column (200) making said ends (203) pass through the hollow space of the tubes (30), allowing the device (100) to rest upon the springing point of the column (200), as shown in FIG. 3.

Figure 4:
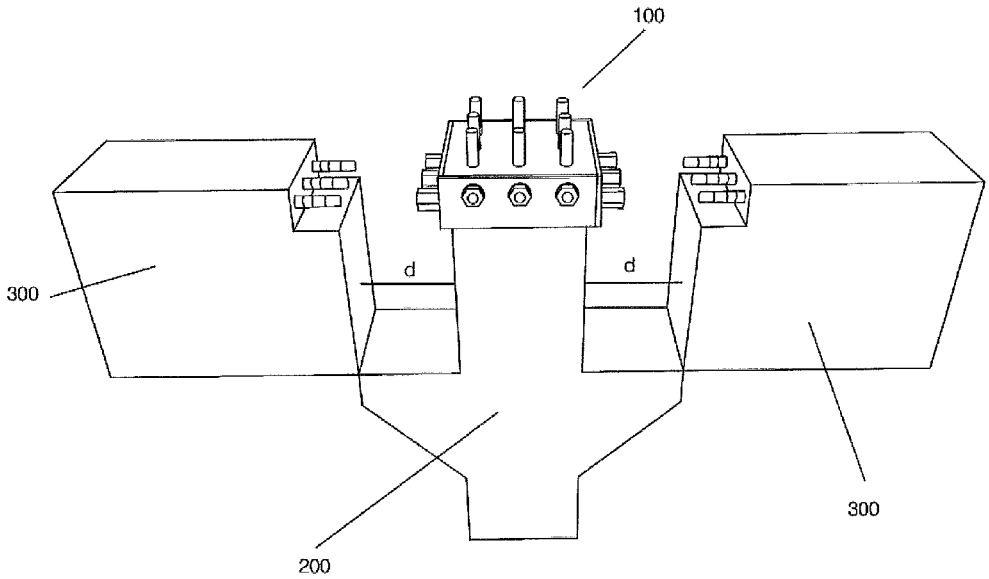
FIG. 4—Shows a perspective view of the column and the joining device as shown in FIG. 3, where two precast concrete beams being brought in closer may be seen.

Subsequently, the precast beams (300) are placed upon the cantilevers (201,202), letting the weight rest thereon, and they are brought in closer, leaving a space (d) in which to operate, as shown in FIG. 4.

Figure 5:
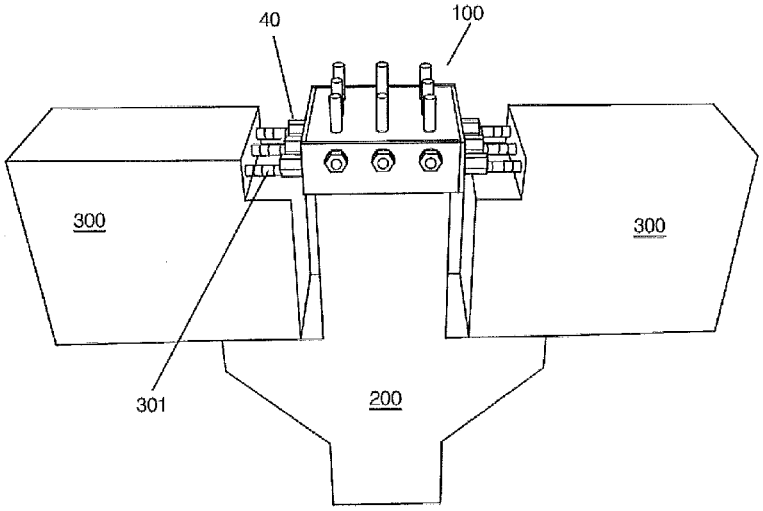
FIG. 5—Shows a perspective view of the column, the beams and the joining device as shown in FIG. 4, in the final screwing position.

Lastly, the beams (300) are brought closer to the joining device (100), bringing the threaded ends (301) of the beams (300) face-to-face with the nuts (40) of the joining device (100), unscrewing on one side in order to screw in on the other, completing the joining process as shown in FIG. 5. If the column (200) is on an edge or corner, a commercial flange nut with a skirt and a washer is left on the other side to distribute the load such that the reinforcement is anchored, although the enclosure formed by the stud and the bifurcated reinforcement surrounding the vertical reinforcement and the adherence between the reinforcement and the structural filler material (concrete, resin, composite, etc.) will also play a part.

The invention claimed is:

1. A dry joint joining device between columns and beams of precast reinforced concrete, which comprises:

a first group of joining reinforcements arranged on a first plane and in parallel with one another, each one of said joining reinforcements comprising at least one reinforcement and two threaded ends;

a column rebar coupling means for coupling to rebars of the columns, the column rebar coupling means being arranged between the joining reinforcements and perpendicular to the first plane defined by the joining reinforcements;

a plurality of anchoring plates arranged so as to define a closed frame inside of which the joining reinforcements are arranged, and wherein an inner space defined by the anchoring plates is filled with a structural filler material, in such a way that the joining reinforcements and the column rebar coupling means are partially embedded within said structural filler material and the column rebar coupling means extend through a side of the structural filler material, said anchoring plates comprising a plurality of holes, at least one for each threaded end, in a position that matches up with said threaded ends, in such a way that through said holes the threaded ends of the joining reinforcements remain accessible; and beam rebar coupling means on the threaded ends.

2. The joining device according to claim 1, which comprises a second group of joining reinforcements arranged on a second plane and in parallel with one another, the second plane being parallel to the first plane.

3. The joining device according to claim 1, which comprises a second group of joining reinforcements arranged in a direction that is perpendicular to the first group of reinforcements.

4. The joining device according to claim 1, wherein the joining reinforcements are bifurcated, comprising two reinforcements and two threaded ends, the reinforcements being parallel to one another in such a way that they create a space for the column rebar coupling means to pass through.

5. The joining device according to claim 1, wherein the column rebar coupling means for coupling to the columns are tubes designed to house the ends of the rebars of the columns.

6. The joining device of claim 1, wherein the beam rebar coupling means are nuts configured to join the threaded ends of the reinforcements to threaded ends of the rebars of at least one beam.

7. A method of manufacturing a dry joint joining device between columns and beams of precast reinforced concrete, characterized in that it comprises the steps of:

h) obtaining a joining reinforcement that comprises one reinforcement and two threaded ends, i) aligning a first group of joining reinforcements on a single first plane and in parallel with one another, j) incorporating column rebar coupling means for coupling to rebars of the columns between the joining reinforcements and perpendicular to the first plane, k) placing a plurality of anchoring plates arranged so as to define a closed frame inside of which the first group of joining reinforcements is arranged, l) inserting each threaded end of the joining reinforcements through holes in each anchoring plate, m) filling the inner space defined by the anchoring plates with a structural filler material, the column rebar coupling means extending through a side of the structural filler material, n) placing beam rebar coupling means on the threaded ends to close the holes through which the studs protrude.

8. The method of manufacturing according to claim 7, wherein the anchoring plates are welded into position by means of a fillet weld bead, welded on the inside of the corner, leaving a space of 10 mm from the edge of the corner on both sides of the corner, and with a throat of at least 5 mm.

9. The method of manufacturing according to claim 7, comprising superimposing a second group of joining reinforcements on a second plane in parallel to the first plane.

10. The method of manufacturing according to claim 7, wherein a second group of reinforcements is arranged in a direction that is perpendicular to the first group of reinforcements.

11. The method of manufacturing according to claim 7, wherein the joining reinforcements have a bifurcated shape, comprising two reinforcements and two threaded ends, the reinforcements being parallel to one another in such a way that they create a space for the column rebar coupling means to pass through.

12. The method of manufacturing according to claim 7, wherein the column rebar coupling means are tubes.

13. The method of manufacturing according to claim 7, wherein the second coupling means are nuts.

14. A use of the joining device in accordance with claim 1 with a precast column that comprises, at least, one cantilever for supporting at least one beam and a plurality of ends of the vertical rebars of the column in such a way that said joining device is placed upon the ends of the vertical rebar of the column, joining together said ends by means of first coupling means of said joining device, allowing the device to rest upon a springing point of the column, in such a way that at least one precast beam is situated upon at least one cantilever, allowing its weight to rest thereon, and is brought closer, bringing threaded ends of a beam rebar face-to-face with second coupling means of the joining device, joining them together.

* * * * *